United States Patent [19]

Palau et al.

[11] Patent Number: 5,038,837

[45] Date of Patent: Aug. 13, 1991

[54] JACQUARD SHED FORMING DEVICE WITH DOUBLE TACKLE ASSEMBLY

[75] Inventors: Joseph Palau, Duingt; Dario Bassi, Vénissieux, both of France

[73] Assignee: Etablissements Staubli-Verdol, Chassieu, France

[21] Appl. No.: 522,098

[22] Filed: May 11, 1990

[30] Foreign Application Priority Data

May 24, 1989 [FR] France ..... 89 07038

[51] Int. Cl.[5] ..... D03C 3/06; D03C 3/20

[52] U.S. Cl. ..... 139/65; 139/455

[58] Field of Search ..... 139/65, 59, 455

[56] References Cited

U.S. PATENT DOCUMENTS 4,530,382 7/1985 Schleicher ..... 139/65 X 4,739,806 4/1988 Palau et al. .

FOREIGN PATENT DOCUMENTS 307824 3/1989 European Pat. Off. ..... 139/65

1513410 2/1968 France .

609113 9/1960 Italy ..... 139/65

367452 3/1963 Sweden .

*Primary Examiner*—Andrew M. Falik

*Attorney, Agent, or Firm*—Dowell & Dowell

[57] ABSTRACT

A three-position weaving mechanism for a weaving loom which includes a plurality of shed-forming devices having tackle assemblies disposed in side by side relationship and wherein the lower pulleys of adjacent tackle assemblies are joined by a cord which passes over such pulleys and an intermediate idler pulley which is secured to the frame of the weaving loom.

5 Claims, 4 Drawing Sheets

JACQUARD SHED FORMING DEVICE WITH DOUBLE TACKLE ASSEMBLY

BACKGROUND OF THE INVENTION

The present invention relates to a device for guiding the warp yarns in three different positions via a plurality of vertically mobile griffe frames.

DESCRIPTION OF THE RELATED ART

Devices of this type are known to exist, which generally comprise one single griffe frame, as described in French Patent No. 1 513 410 of Dec. 9, 1966.

It is desired that two hooks, selectively controlled by two needles, cooperate with the same griffe frame. At each of the ends of the two hooks are fixed the ends of a cord which passes around a pulley, which is connected via a small rod to another pulley, thus forming a tackle assembly. Around this second pulley another cord, of which one of the ends is secured to the frame and the other end includes a collar associated with a heddle. In this device, the two hooks are selectively controlled by two needles, and the two knives with which they cooperate form part of the same griffe frame, thus allowing the collar provided with the warp yarn to arrive either in an upper position, in an intermediate position or in a lower position. The upper and lower positions are respectively reached when the two hooks are retained by the griffe frame and their vertical stroke is equal to that of the frame. The intermediate position is established when one of the two hooks is in mesh with the griffe frame, thereby making it possible to displace the collar by half the vertical stroke of the other positions.

Similarly, Swiss Patent No. 367 452 of Apr. 19, 1958 describes a double-lift weaving mechanism in the form of two hooks joined by a cord which passes, as in the French Patent, around one pulley of a tackle assembly, of which the other pulley cooperates with a cord having a fixed end.

To produce a three-position weaving mechanism, two systems with two hooks must be used, of which the second pulleys of the tackle assemblies are surrounded by a cord with fixed ends and which encircles the first pulley of a third tackle assembly of which the other pulley is encircled by a harness cord with a fixed end.

The three-position weaving mechanisms described in the prior art Patents present certain drawbacks as far as the vertical guiding of the different tackle assemblies is concerned. These assemblies tend to move horizontally during different strokes, and appropriate guiding elements must therefore be provided the cost of such guide element is high and the elements considerably complicate the structure of the mechanism.

It is a particular object of the present invention to overcome the drawbacks set forth hereinbefore.

SUMMARY OF THE INVENTION

The three-position weaving mechanism according to the invention is characterized in that it includes:

two adjacent shed-forming devices each including two hooks vertically movable under the effect of knives which move in opposition, in a reciprocating movement. These hooks are joined by a cord passing around one of the pulleys of a tackle assembly;

a pulley mounted idly on a shaft which is fixed in relationship with respect to the frame of the mechanism;

and a cord of which one of the ends is anchored to the frame of the mechanism and which successively passes over the second pulley of the tackle assembly of the first shed-forming device, the idle pulley, and the second shed-forming pulley of the tackle assembly of the second device. The second end of the cord is connected with a collar to which at least one heddle is fastened.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
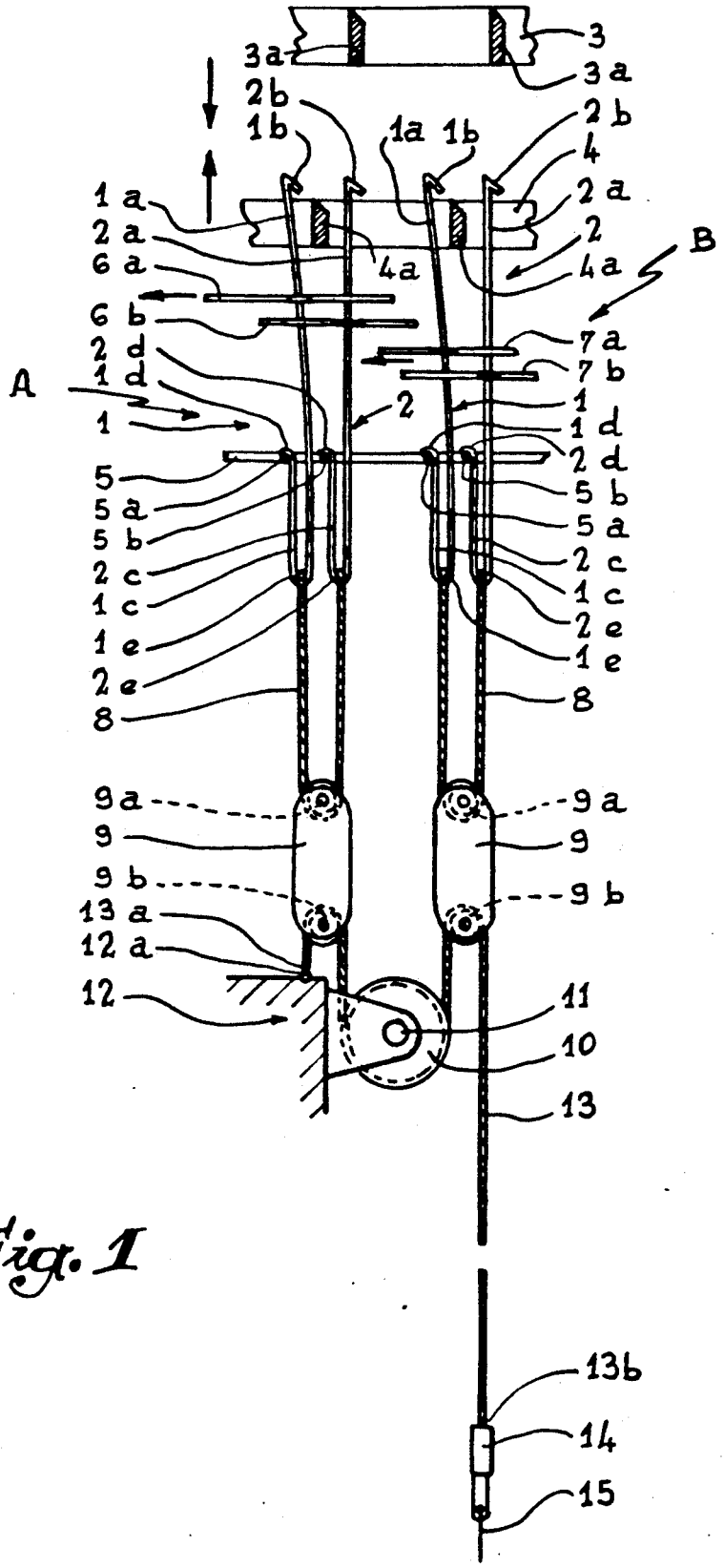
FIGS. 1 to 3 are side elevational views illustrating the assembly of the elements of a weaving mechanism according to the invention, with the collar of the harness being respectively in lower, intermediate and upper position.

Referring now to the drawings, FIG. 1 shows two shed-forming devices A and B each comprising two movable hooks 1 and 2 adapted to cooperate with two griffe frames 3 and 4 having knives 3*a* and 4*a*.

Hooks 1 and 2 include a rectilinear principal arm 1*a* and 2*a* of which the upper end is provided with a barb 1*b* and 2*b*, while their lower ends are bent to form a second, vertical, arm 1*c*, 2*c*, provided with a hooks, 1*d*, 2*d* cooperating respectively with bars 5*a* and 5*b* of the comberboard grid 5.

Each of the arms 1*a*, 2*a* of hooks 1 and 2 passes in the ring of a press needle referenced 6*a*, 6*b* and 7*a*, 7*b* which, in known manner, makes it possible for the barbs 1*b*, 2*b* to be displaced from the knives 3*a*, 4*a* when it is not desired that the hooks be gripped by the knives.

Links 1*e*, 2*e* of arms 1*a*–2*c* or 1*a*–2*c* respectively of hooks 1 and 2 are joined by a cord 8 passing around a pulley 9*a* of a tackle assembly 9.

Between the two devices A and B, a pulley 10 has been provided, rotating freely about a spindle 11 secured to the frame 12 of the weaving mechanism. The second pulleys 9*b* of the two tackle assemblies 9 of the two devices A and B, and pulley 10 are engaged by another cord 13 of which one of the ends 13*a* is attached to a fixed point 12*a* of the frame 12, while its other end 13*b* carries a snap 14 which constitutes the collar to which at least one heddle 15 is fixed.

Figure 2:
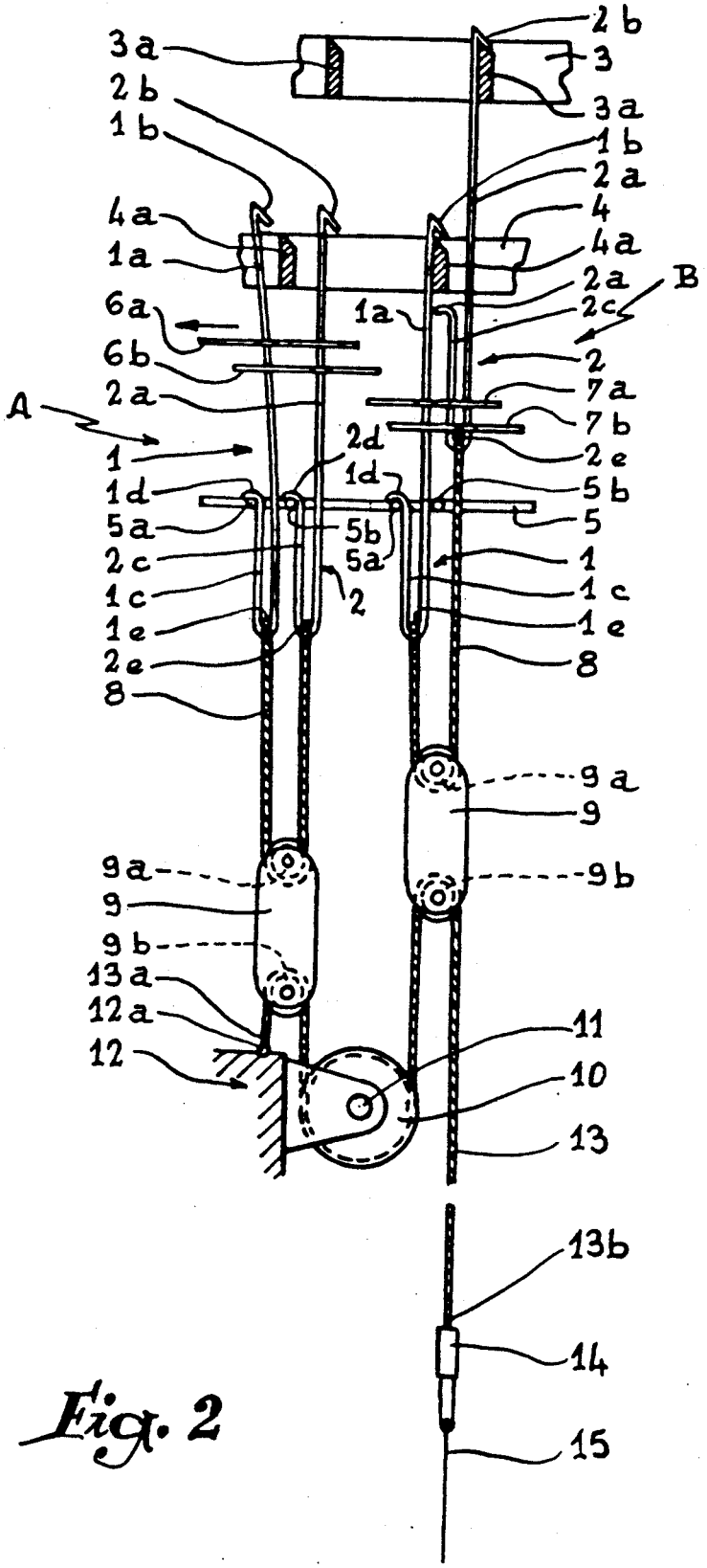
Figure 3:
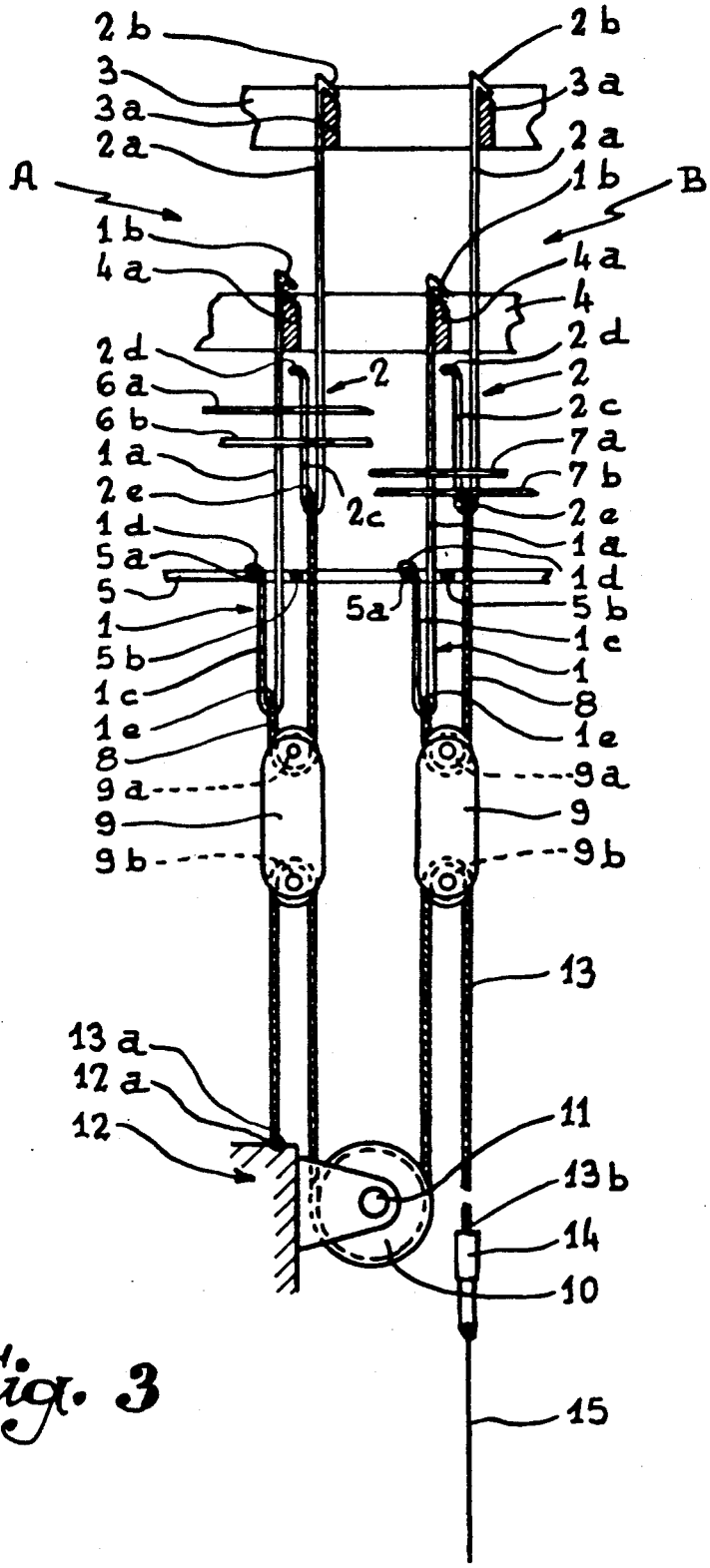

A double tackle assembly is thus produced, enabling the three desired positions of the collar 14 to be obtained, namely a low position corresponding to the lower position of the warp yarns (FIG. 1), a horizontal or intermediate position thereof (FIG. 2) and a high or upper position of these yarns (FIG. 3).

When the warp yarns are to be in low position (FIG. 1), the arms 1*a* of devices A and B are pressed so that knife 4*a* does not engage the corresponding barbs 1*b* when the griffe frame 4 rises. Similarly, the hooks 2 are pressed so that barbs 2*b* are engaged by the knife 3*a* corresponding to the griffe frame 3 when it rises. In this way, the collar 14 remains in the low position and all the hooks 1*d*, 2*d* of devices A and B rest on the bars 5*a*, 5*b* of the grid 5.

The intermediate position shown in FIG. 2 is produced by the fact that the arms 1*a*, 2*a* of the hooks 1 and 2 of device A are pressed alternately, so that the hooks 1*d*, 2*d* are in abutment against the bars 5*a*, 5*b* of the grid 5. On the contrary, barbs 1*b*, 2*b* of the hooks of device B remain in mesh with the knives 3*a*, 4*a* during the reciprocating movement of the griffe frames 3 and 4.

Finally, if collar 14 is in the high position (FIG. 3), the barbs 1*b*, 2*b* of the four hooks 1 and 2 of devices A and B are left in mesh with the knives 3*a*, 4*a* of the two griffe frames 3 and 4.

Of course, the preceding arrangement may also be applied to a weaving mechanism of the type described in Applicants' U.S. Pat. No. 4,739,806.

Figure 4:
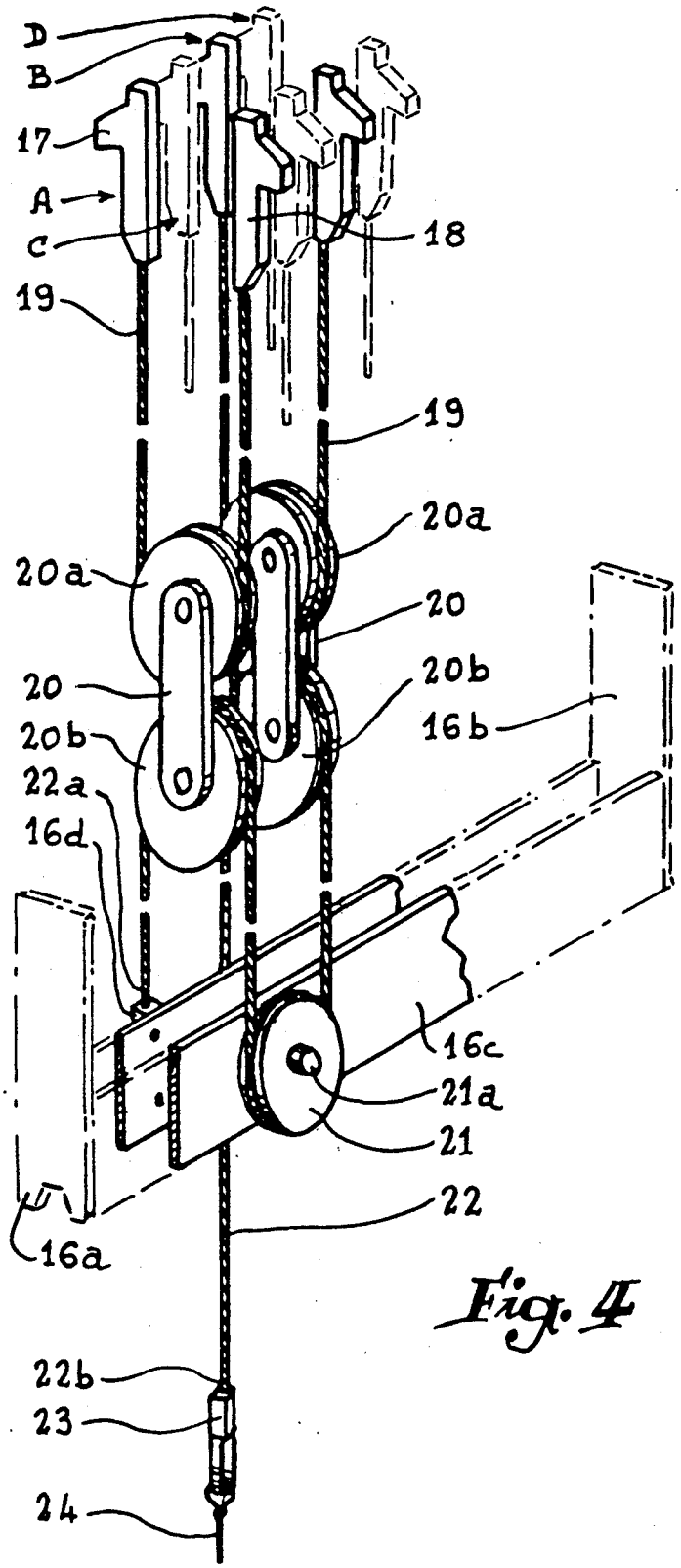
FIG. 4 is a view similar to that of FIG. 1, but illustrating a preferred embodiment of the invention.

FIG. 4 shows a module 16 comprising a plurality of vertical partitions 16*a*, 16*b*, etc . . . , between each of which are located the shed-forming devices A, B, C, D . . . , each constituted by two hooks 17, 18 joined by a cord 19 passing over the first pulley 20*a* of a tackle assembly 20 guided between the partitions.

These hooks 17, 18 move vertically via knives disposed on griffe frames (not shown) and exhibit a reciprocating movement. Retaining elements associated with electro-magnets are capable of retaining the mobile hooks 17, 18 in high position. Such a structure according to U.S. Pat. No. 4,739,806 will not be described in greater detail, however the teachings of the patent are incorporated herein by reference.

In accordance with the invention, an idle pulley 21 has been provided, of which the shaft for rotation 21*a* is secured on a horizontal wall or element 16*c* of the module 16. The second pulleys 20*b* of the tackle assemblies 20 of two devices A and B of the module 16 and the idle pulley 21 are engaged by a cord 22 of which one of the ends 22*a* is anchored to a fixed point 16*d* of the module. While its other end 22*b* carries a snap 23 which constitutes the collar to which at least one heddle 24 is fixed.

A double tackle assembly is thus obtained, making it possible to produce the three positions described hereinabove, but applied to a module described in Applicants' aforementioned U.S. patent and which requires no additional guiding means with respect to those of a standard module, with the result that a mechanism thus produced is economical and highly simple to manufacture and maintain.

It must, moreover, be understood that the foregoing description has been given only by way of example and that it in no way limits the domain of the invention which would not be exceeded by replacing the details of execution described by any other equivalents.

What is claimed is:

1. A weaving mechanism adapted to provide three positions of the warp yarns in a weaving loom having a frame wherein the mechanism comprises, two adjacent shed-forming devices each including a pair of hooks which are joined by a first cord and a tackle assembly, knife means for engaging and moving said hooks in reciprocal relationship with respect to one another, each tackle assembly including upper and lower pulleys, said first cord passing partially around said upper pulley of said tackle assemblies, an idler pulley freely rotatably mounted to the frame, a second cord having a first end secured relative to the frame and a second end, collar means for attaching said second end of said second cord to a heddle, and said second cord consecutively extending partially around and engaging said lower pulley of said tackle assembly of one of said shed-forming devices, said idler pulley and said lower pulley of said tackle assembly of said other of said shed-forming devices.

2. The weaving mechanism of claim 1 wherein the weaving loom includes a griffe frame for supporting said knife means and a comberboard, said hooks having a first arm having a barb extending therefrom for engagement with said knife means and a second arm forming a rest for said hook on the comberboard, and a press needle selectively engageable with said first arm of each hook for urging the hooks outwardly with respect to said knife means whereby said knife means will not engage said hooks as the knife means is reciprocated.

3. The weaving mechanism of claim 2 in which said idler pulley is oriented generally parallel with said upper and lower pulleys of said tackle assemblies.

4. A weaving mechanism adapted to provide three positions of the warp yarns in a weaving loom having a frame wherein the mechanism comprises, a module having a plurality of vertical partitions connected by horizontal elements, at least two adjacent shed-forming devices mounted between a pair of said vertical partitions, each shed-forming device including a pair of hooks which are joined by a first cord and a tackle assembly, knife means for engaging and moving said hooks in reciprocal relationship with respect to one another, each tackle assembly including upper and lower pulleys, said first cord passing partially around said upper pulley of said tackle assemblies, an idler pulley freely rotatably mounted to said horizontal element of said module, a second cord having a first end secured relative to said module and a second end, collar means for attaching said second end of said second cord to a heddle, and said second cord consecutively extending partially around and engaging said lower pulley of said tackle assembly of one of said shed-forming devices, said idler pulley and said lower pulley of said tackle assembly of said other of said shed-forming devices.

5. The weaving mechanism of claim 4 in which said idler pulley is oriented generally perpendicular with said upper and lower pulleys of said tackle assemblies.

* * * * *